US006614163B1

(12) United States Patent
Bae et al.

(10) Patent No.: US 6,614,163 B1
(45) Date of Patent: Sep. 2, 2003

(54) CATHODE RAY TUBE

(75) Inventors: Min-Cheol Bae, Suwon-si (KR); Jae-Young Ha, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 09/513,068

(22) Filed: Feb. 24, 2000

(30) Foreign Application Priority Data

Jun. 21, 1999 (KR) ..... 1999-11043
Jun. 21, 1999 (KR) ..... 1999-11044

(51) Int. Cl.[7] ..... H01J 5/22
(52) U.S. Cl. ..... 313/477 HC; 313/318; 313/477 R
(58) Field of Search ..... 313/477 HC, 318.05, 313/318.01, 318.06, 318.08, 51, 479, 482, 317; 445/45; 439/602, 618

(56) References Cited

U.S. PATENT DOCUMENTS 2,568,460 A * 9/1951 Nolte ..... 313/318.05
3,294,999 A * 12/1966 Hekken ..... 313/70
4,608,516 A * 8/1986 Oki ..... 313/477 HC
5,354,221 A * 10/1994 Doherty, II et al. ..... 439/683
5,898,264 A * 4/1999 Nose et al. ..... 313/477 HC
6,186,851 B1 * 2/2001 Matsumoto et al. ..... 445/43
6,305,988 B1 10/2001 Arakawa et al. ..... 439/683

FOREIGN PATENT DOCUMENTS

JP 62295339 * 12/1987 ..... 445/24

* cited by examiner

*Primary Examiner*—Nimeshkumar D. Patel
*Assistant Examiner*—Ken A Berck
(74) *Attorney, Agent, or Firm*—Christie, Parker & Hale, LLP

(57) ABSTRACT

The periphery of a stem, which seals off the neck of a CRT and supports pins providing electrical current to some of electron gun's electrodes, is designed to contact either inner surface or outer surface of the neck end as well as the cross section thereof in order to prevent pores when the stem and the neck are fused together.

20 Claims, 8 Drawing Sheets

CATHODE RAY TUBE

FIELD OF THE INVENTION

The present invention relates to the CRT's stem portion and an improved shape of the stem that allows more uniform and airtight sealing between the neck and the stem.

BACKGROUND OF THE INVENTION

Referring to FIGS. 8 and 9, a CRT has a face panel 15, a funnel portion 25, and a neck portion 3. The CRT displays images when electron beams 13 emitted from an electron gun 11 installed in the neck portion collide with phosphors 17 coated on the inner surface of the face panel 15. The electron gun 11 is secured on a flat disk-like stem 1, made of glass. A plurality of pins 23 penetrates the stem so that one end of each pin is connected to an electrode 21 of the electron gun 11 while the other end is connected to an external signal source for providing control current to the electrodes 21. The electrodes 21 focus and accelerate electrons emitted from a cathode 19 into beams. Once the electron gun 11 is supported by the pins 23 of the stem it is inserted into the neck portion 3 of a CRT. FIG. 10 shows a conventional method of sealing the stem to the end of the neck. The stem 1 is inserted somewhat into the neck 3 and the outer neck area corresponding to the stem base 5 is heated by a torch flame 7 until they are fused and sealed together. The remaining portion of the neck below the stem is cut away. However, in the process minute glass particles might find their way into the neck through the evacuation tube 9, adversely affecting the performance of the CRT. As a solution to this drawback another conventional method, as shown in FIG. 11, was devised where the diameter of a stem base 5 is about the same as the outer diameter of the neck end. Therefore, instead of being inserted into the neck the periphery of the upper surface of the stem contacts the cross section 3*a* of the neck end before fused together. But this alternative has its own drawback. Since the neck is made by cutting a long glass tube its cross section is not necessarily completely flat and smooth. A result is that it is placed on the flat surface of the stem there happens to be slight undesirable space indicated by t in FIG. 12 between the neck cross section 3*a* and the stem surface. This space causes tiny holes in the sealing surfaces. The torch flame may enter the neck through the holes possibly damaging parts of the electron gun by oxidizing the cathode support and stem pins.

SUMMARY OF THE INVENTION

An objective of the present invention is to provide a uniform sealing between the neck and the stem. Space between the surfaces of the neck end and the stem to be contacted together are minimized by raising either central or peripheral portion of a stem so that the neck end. The neck is more securely supported on the stem prior to fusion and this helps non-porous sealing of the neck end.

BRIEF DESCRIPTION OF THE INVENTION

DETAILED DESCRIPTION OF THE PRESENT INVENTION

Figure 3:
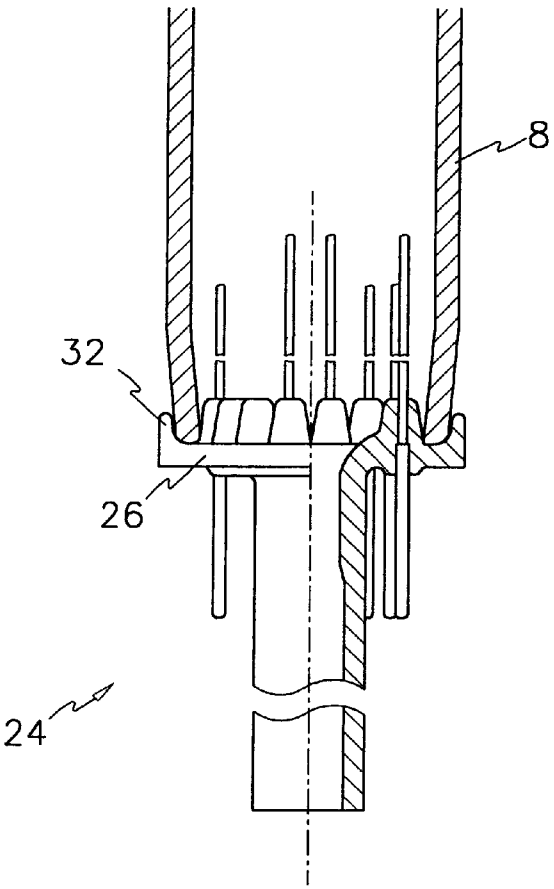
FIG. 3 shows a variation of the first embodiment according to the present invention.
Figure 1:
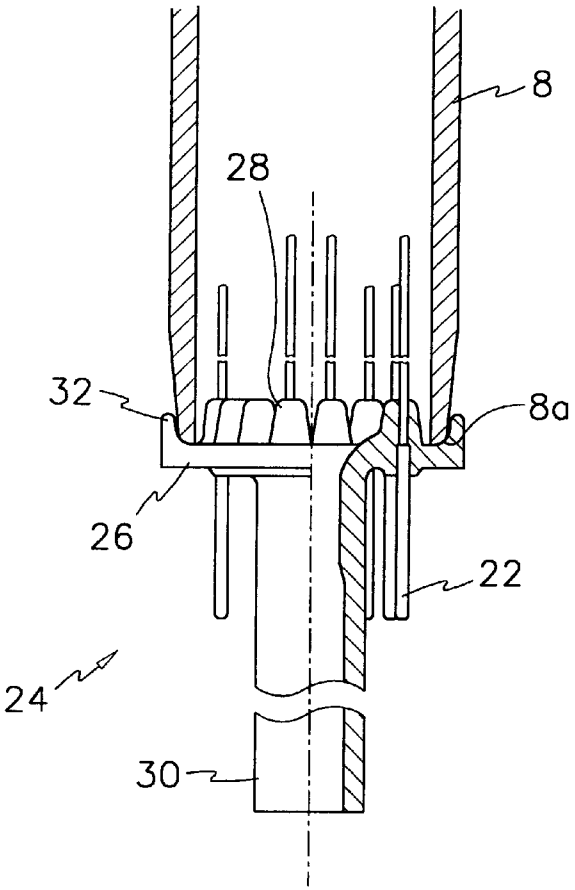
FIG. 1 shows a first embodiment of a stem according to the present invention.
Figure 2:
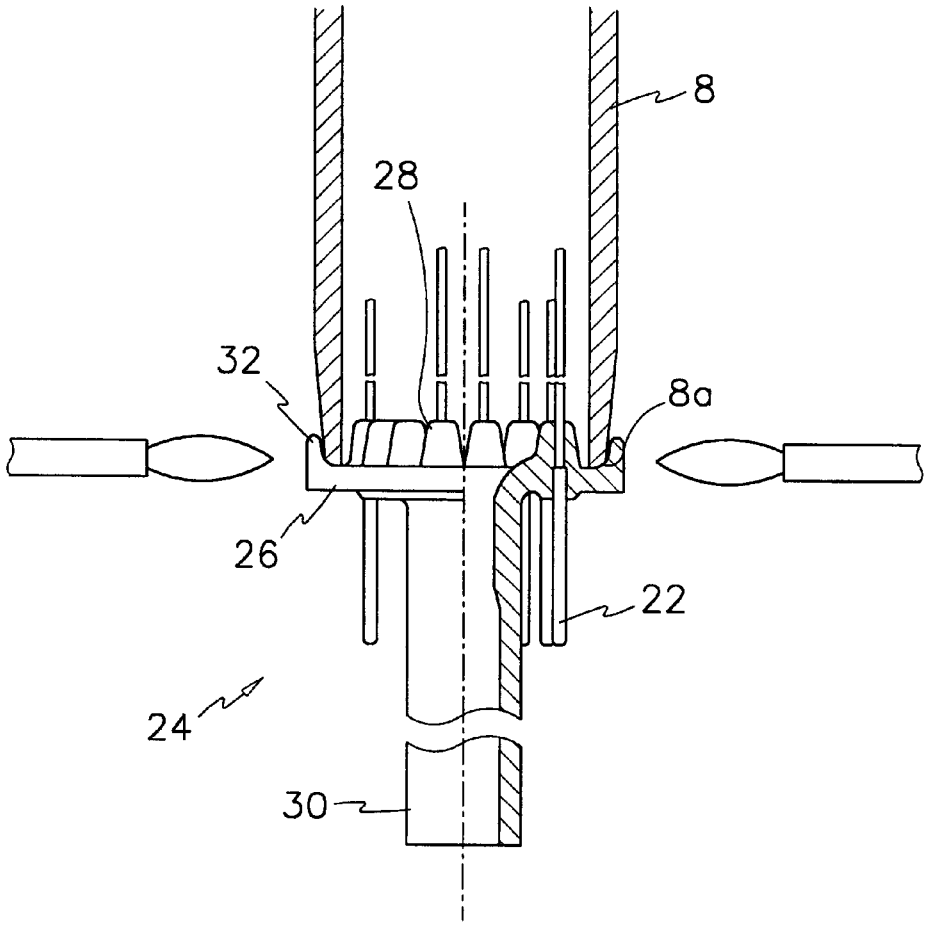
FIG. 2 shows a heating configuration to fuse the stem of the first embodiment to the neck end.

FIG. 1 shows a stem 24 placed against the neck 8 according to a first embodiment of the present invention. A plurality of pins 22 are arranged annularly in the stem extending in either direction perpendicular with respect to the plane of the stem. The stem is also provided with an evacuation tube 30 through which air inside the tube is sucked out to seal off the tube after the stem is fused to the neck. A stem mound 28 is formed at each pin base facing the neck to fixedly support the pin. The periphery of the stem disk 26 is bent toward the neck forming a circular rim 32. The inner diameter of the rim 32 is designed to be slightly greater than the outer diameter of the neck 8 just enough for the neck to fit inside the rim. In other words the rim 32 surrounds the end of the neck. The height of the rim 32 is preferably in the range of 0.5 to 1 mm so that any possible gap between the cross section 8*a* of the neck end and the upper surface of the stem can be covered. The cross-section of the neck end contacts the flat upper surface of the stem. Also the outer surface of the neck end contacts the inner surface of the rim when the neck and the stem are joined.

Figure 5:
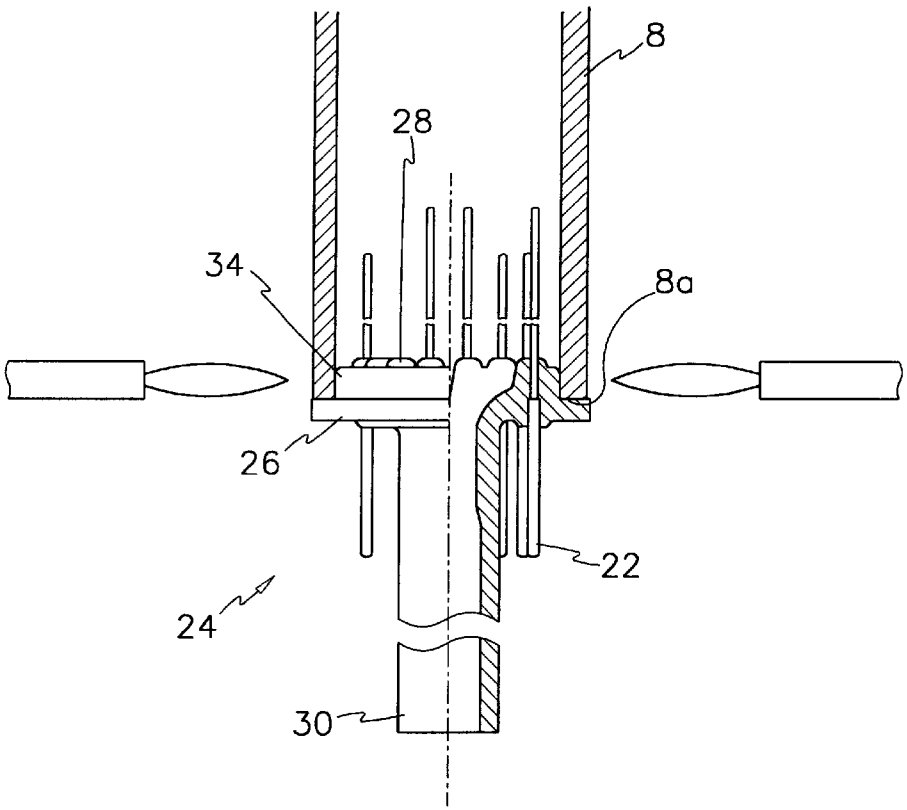
FIG. 5 shows a heating configuration to fuse the stem of the second embodiment to the neck end.
Figure 4:
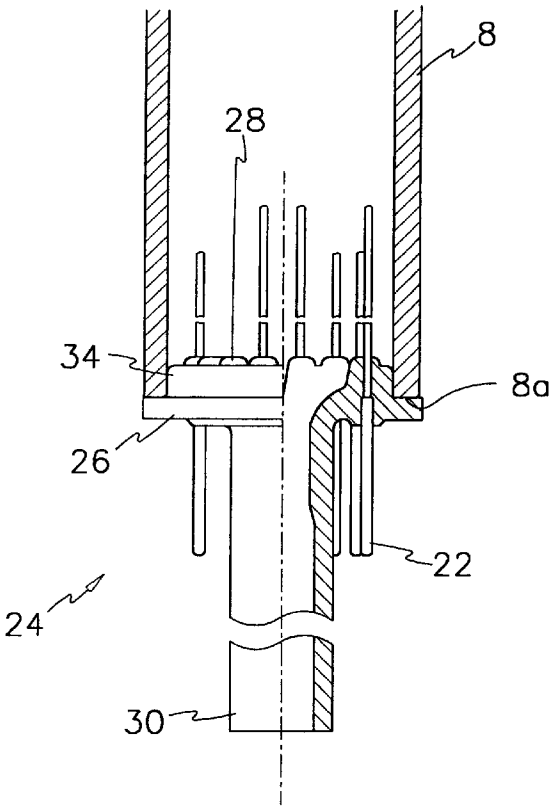
FIG. 4 shows a second embodiment of a stem according to the present invention.

FIG. 4 shows a second embodiment of the present invention. The diameter of the stem disk 26 is slightly larger than that of the outer diameter of the neck end so that the whole cross section of the neck end is allowed to contact the stem upper surface. Further, a stem mound base 34 is formed on the upper surface of the stem such that its side contacts the inner surface of the neck end. In other words, the diameter of the stem mound base 34 is such that the neck end can surround the mound base with as little space as possible. Ideally, the diameter of the base should be equal to the inner neck diameter. For easy insertion into the neck in practice, the diameter can be slightly smaller. The height of the base is such that the neck can be secured on the stem. After the neck and stem are arranged in this configuration, heat is applied around the neck so that the neck end and the periphery of the stem melt and are fused together as shown in FIG. 5.

Figure 6:
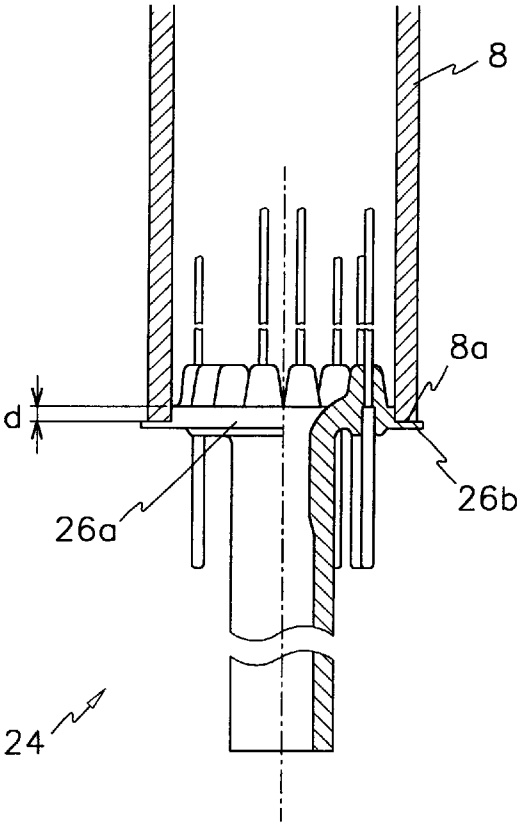
FIG. 6 shows a third embodiment of a stem according to the present invention.
Figure 8:
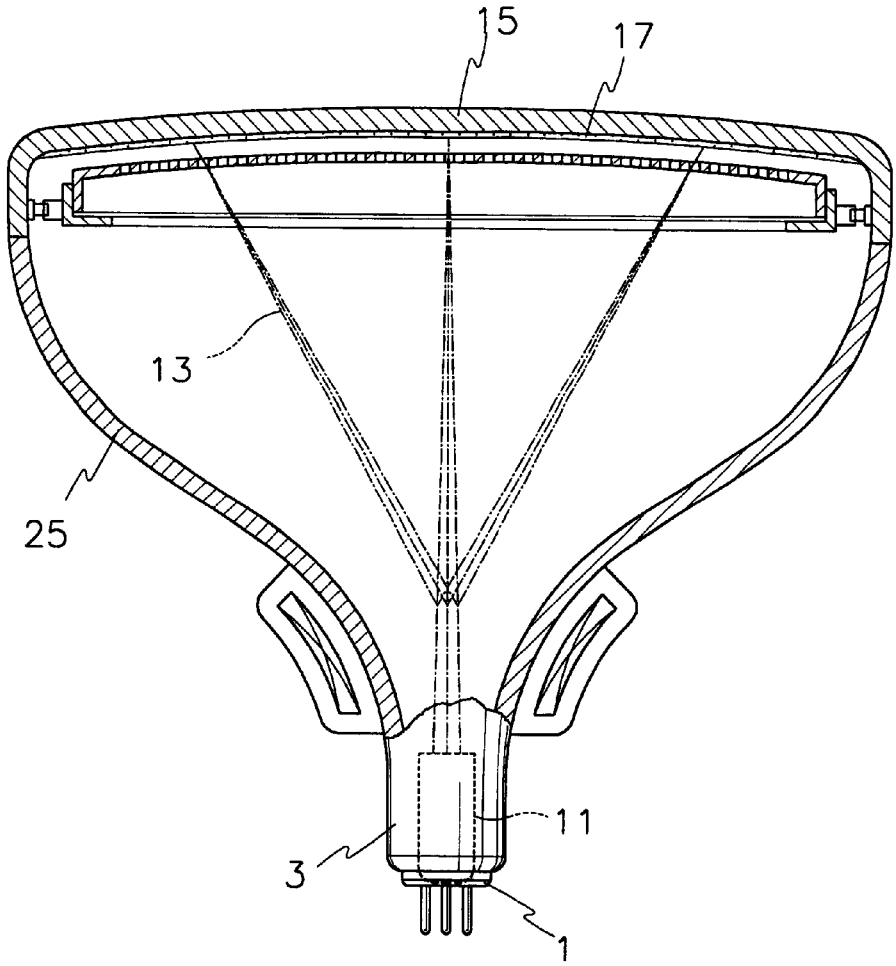
FIG.8 (PRIOR ART)
FIG. 8 is a cross section of a CRT.
Figure 9:
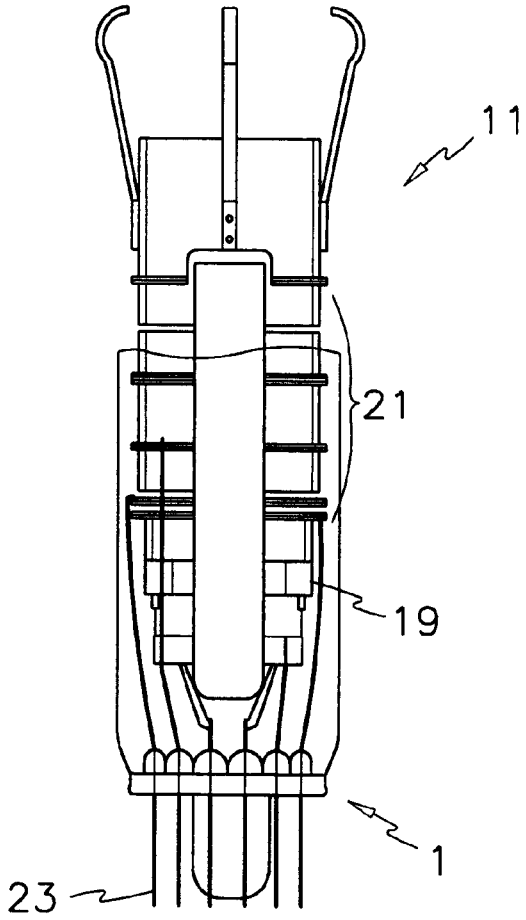
FIG.9 (PRIOR ART)
FIG. 9 shows a side view of an electron gun supported on the stem.
Figure 10:
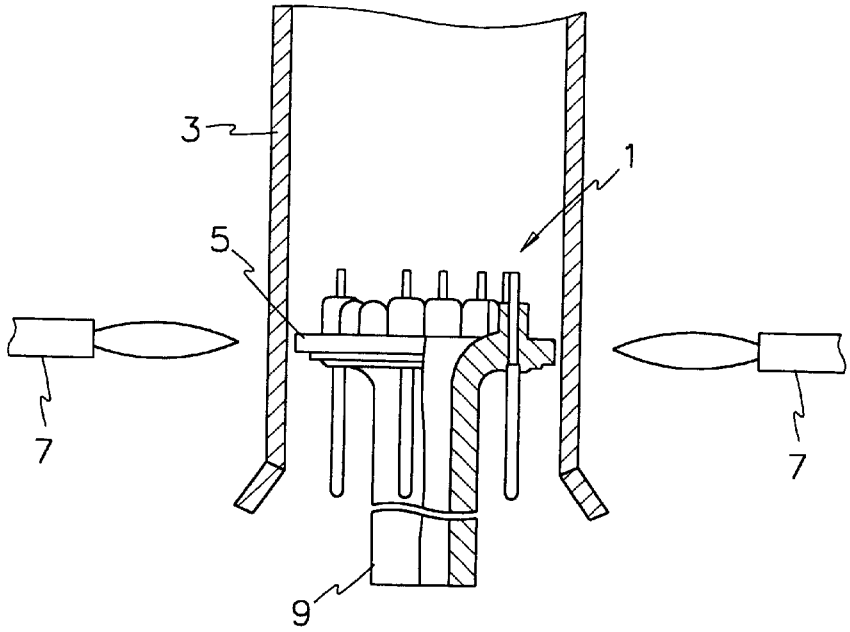
FIG.10 (PRIOR ART)
FIG. 10 shows a conventional stem sealing arrangement.
Figure 11:
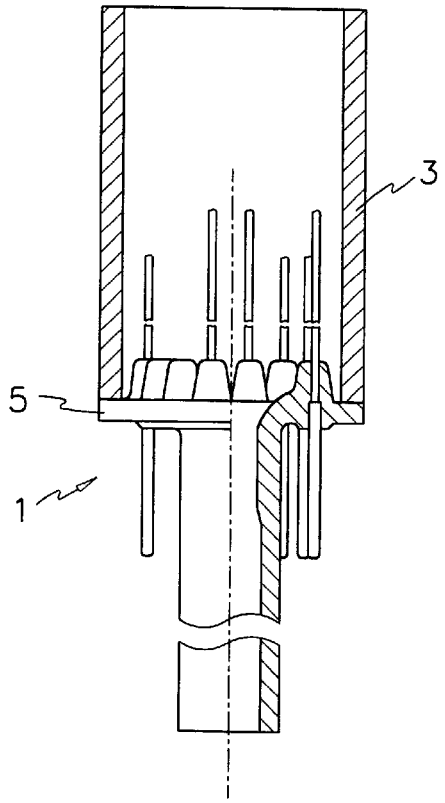
FIG.11 (PRIOR ART)
FIG. 11 shows a conventional culletless stem sealing arrangement in an ideal condition.
Figure 12:
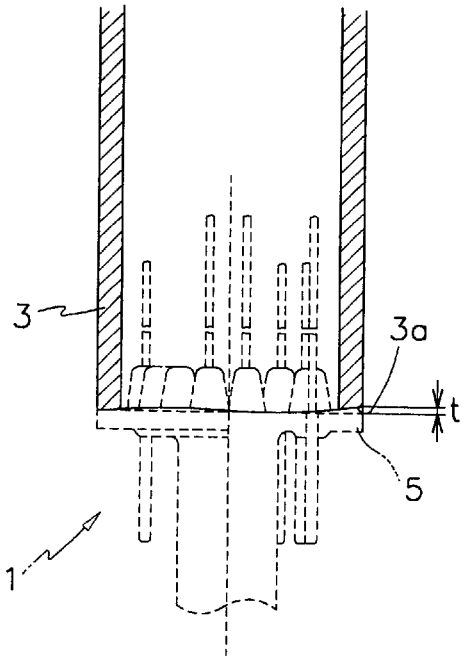
FIG.12 (PRIOR ART)
FIG. 12 shows a conventional culletless stem sealing arrangement in practice.

FIG. 6 shows a third embodiment of the present invention. Rather than providing additional stem base as in the case of the second embodiment, an indention is made directly on an peripheral area 26*b* of the stem which would come into contact with the cross section of the neck end. The diameter of the non-indented portion 26*a* of the stem is made equal to or slightly smaller than the inner diameter of the neck end so that the neck end can surround the whole non-indented portion. The depth of the indention d is such that it any possible gap between the cross section 8*a* of the neck end and the upper surface of the stem can be sufficiently covered.

Figure 7:
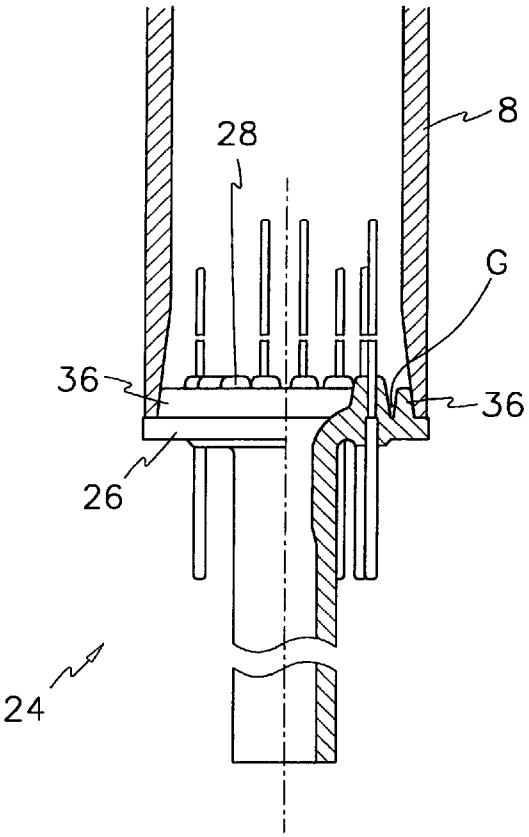
FIG. 7 shows a fourth embodiment of a stem according to the present invention.

FIG. 7 shows a fourth embodiment of the present invention. With some distance from the peripheral edge of the stem a circular rim 36 is formed to surround the stem mounds 28. The outer diameter of the rim 36 is equal to or slightly smaller than the inner diameter of the neck end 8 so that the neck end can be placed over the rim. In this case the inner diameter of the neck end is preferred to progressively increase in order to provide as much space as possible for the stem mounds 28 inside the neck 8.

For the neck and stem arranged in the third and fourth embodiment heat is applied around the neck so that the neck end and the periphery of the stem are melt and fused together as shown in FIG. 7.

With the present invention minute holes that otherwise might be formed between the neck end and the stem are hardly present, thus preventing flame, used for heating, from entering the neck. It also allows more precise alignment of the neck and the stem because the neck end is practically placed in a circular groove formed between by the rim and the stem mounds. Since the neck end surrounds a raised portion of the stem a conventional drawback of rapid thinning of the stem periphery during the fusion process. Additionally the stem may be controllably moved up or down a little along the neck axis during the fusion process slight differences among the necks can be compensated to yield a same CRTs having more uniform neck length.

What is claimed is:

1. A cathode ray tube comprising;

a face panel;

a funnel portion coupled to the face panel, said funnel portion having a neck with an exterior surface; and a stem separate from the neck and coupled to an end of the neck, wherein said stem has a raised portion extending over the neck, said raised portion being in contact with the exterior surface of the neck so that the end of the neck fits inside of the raised portion of said stem.

2. A cathode ray tube as claimed in claim 1, wherein the neck comprises an inner and an outer surface and wherein a diameter of the outer surface becomes smaller toward an end of the neck where the neck is coupled to the stem.

3. A cathode ray tube as claimed in claim 2, wherein both the outer and inner surface diameters of the neck become progressively smaller toward the end of the neck where the neck is coupled to the stem.

4. A cathode ray tube as claimed in claim 1, wherein the height of said raised portion of said stem is in the range of 0.5 to 1 mm.

5. A cathode ray tube as claimed in claim 1, wherein said raised portion is formed by indenting the periphery of the stem on a surface facing the neck.

6. A cathode ray tube as claimed in claim 1, wherein said raised portion is formed a distance from the peripheral edge of the surface, the distance being substantially equal to the thickness of said neck.

7. A cathode ray tube comprising;

a face panel;

a funnel portion coupled to the face panel, the funnel portion having a neck portion having a thickness, a length, a diameter, a cross-section surface, an interior surface, and an exterior surface; and a stem coupled to an end of the neck portion, the stem having a round disc shaped portion, a raised mound portion extending from the disk shaped portion along the length of the neck portion and extending within the neck portion contacting the interior surface of the end of the neck portion, a raised portion extending from the disk shaped portion along the diameter of the neck portion and surrounding the neck portion contacting the cross-section surface of the end of the neck portion.

8. A cathode ray tube as claimed in claim 1, wherein said raised portion is formed a distance from the peripheral edge of the surface, the distance being substantially equal to the thickness of said neck.

9. A cathode ray tube as claimed in claim 7, wherein both an outer diameter and an inner diameter of the neck portion become progressively smaller toward the end of the neck portion;

wherein the thickness of the neck portion remains constant toward the end; and wherein the exterior surface of the neck portion is positioned inside of the raised portion of the stem.

10. A cathode ray tube as claimed in claim 7, wherein the raised portion of the stem is formed adjacent to the mound such that an outer surface of the neck portion fits against an inner surface of the raised portion of the stem.

11. A cathode ray tube as claimed in claim 7, wherein the stem is formed such that an outer diameter of the disk portion of the stem is greater than an outer diameter of the end of the neck portion;

wherein a peripheral portion of the disk has a smaller thickness than an inner portion of the disk; and wherein the interior surface of the neck portion and an end of the neck portion are coupled to the disk portion of the stem.

12. A cathode ray tube as claimed in claim 7, wherein an inner diameter of the neck portion becomes progressively larger toward the end of the neck portion;

wherein the interior surface of the neck portion is coupled to the outside of the mound of the stem; and wherein the end of the neck portion is coupled to the disk portion of the stem.

13. A cathode ray tube as claimed in claim 1 wherein the raised portion is a mound base and further comprises a stem mound extending from the mound base.

14. A cathode ray tube as claimed in claim 1 the neck comprises an inner surface and an outer surface and wherein the diameter of a portion of the neck inner surface extending to the stem increases in a direction toward the stem defining a tapered inner surface portion.

15. A cathode ray tube as claimed in claim 14 wherein the diameter of the outer surface of the neck extending to the stem remains constant.

16. A cathode ray tube comprising;

a face panel;

a funnel portion coupled to the face panel, said funnel portion having a hollow neck with an end portion; and a stem coupled to an end of the neck, the stem comprising a disk shaped portion having an inner section and an outer annular section extending radially outward from the inner section wherein the thickness of the outer annular section is less than the thickness of the inner section wherein the outer annular section defines a peripheral annular indentation, whereby a portion of the inner section extends axially beyond the outer annular section, and wherein the end portion of the neck surrounds and contacts the portion of the inner section extending axially beyond the outer annular section and fits on the outer annular section.

17. A cathode ray tube as claimed in claim 16 wherein the neck comprises an inner surface and wherein the inner surface is in contact with the disk inner section.

18. A cathode ray tube as claimed in claim 16 wherein the neck interfaces with the outer annular section.

19. A cathode ray tube as claimed in claim 18 wherein the inner section extends axially beyond the outer section by a distance sufficient to cover any gaps formed at the interface of the neck with the outer annular section.

20. A cathode ray tube as claimed in claim 16 further comprising a raised portion extending axially from the inner section of the disk and over the neck.

* * * * *